US007431590B2

(12) United States Patent
Gerhardt

(10) Patent No.: US 7,431,590 B2
(45) Date of Patent: Oct. 7, 2008

(54) WHITEBOARD SCOREBOARD

(76) Inventor: Therese A. Gerhardt, 172 Meadow Wood Dr., Holden, MA (US) 01520

( * ) Notice: Subject to any disclaimer, the term of this patent is extended or adjusted under 35 U.S.C. 154(b) by 0 days.

(21) Appl. No.: 11/497,246

(22) Filed: Aug. 2, 2006

(65) Prior Publication Data

US 2007/0059677 A1 Mar. 15, 2007

Related U.S. Application Data

(60) Provisional application No. 60/716,977, filed on Sep. 15, 2005.

(51) Int. Cl.
*B43L 1/00* (2006.01)

(52) U.S. Cl. ..... 434/408; 434/247

(58) Field of Classification Search ..... 434/247, 434/408, 414, 415, 416, 421, 428, 430; 428/13, 428/14; D19/52

See application file for complete search history.

(56) References Cited

U.S. PATENT DOCUMENTS

| | | | | |
|---|---|---|---|---|
| 2,608,771 | A | 9/1952 | Sparks | |
| 2,853,044 | A | 9/1958 | Freiberg | |
| 3,246,411 | A | 4/1966 | Aafedt | |
| 3,560,092 | A * | 2/1971 | Coney | 434/248 |
| D229,706 | S | 12/1973 | Lewis | |
| 3,922,805 | A * | 12/1975 | Krug | 40/533 |
| D291,418 | S | 8/1987 | Cormier | |
| 4,805,909 | A | 2/1989 | Roland | |
| 4,831,956 | A * | 5/1989 | Thater | 116/222 |
| D314,711 | S | 2/1991 | Cox | |
| 5,163,845 | A * | 11/1992 | Blassingame | 434/408 |
| 5,232,217 | A * | 8/1993 | Cota et al. | 473/416 |
| 5,263,866 | A * | 11/1993 | Campbell | 434/416 |
| 5,438,950 | A | 8/1995 | Rodrigues | |
| 5,491,324 | A | 2/1996 | Vanderpool | |
| 5,527,568 | A * | 6/1996 | Boone et al. | 428/14 |
| 5,599,189 | A | 2/1997 | Kees | |

(Continued)

FOREIGN PATENT DOCUMENTS

| | | |
|---|---|---|
| GB | 451636 | 8/1936 |

(Continued)

OTHER PUBLICATIONS

"Dart Dealer: Harley Davidson Miniature Scoreboard", 2004 [retrieved online Sep. 25, 2007].*

*Primary Examiner*—Kurt Fernstrom
(74) *Attorney, Agent, or Firm*—Richard C. Litman

(57) ABSTRACT

The whiteboard scoreboard is a dry erase marking surface laminated onto a backboard or other substrate. The whiteboard has rounded corners to prevent injury of an end user or anyone else coming into contact with the device. Permanent indicia forming a template of baseline information is disposed along the marking surface of the whiteboard. The indicia includes a scoring matrix that has a predetermined number of rows and a predetermined number of columns in which the end user may erasably record scoring tallies by application of a dry erase marker to a marking area of the matrix. Optionally, an attachment clip is connected to the backboard for attachment to a support, such as a chair. A dry erase marker clip is attached to the whiteboard so that a dry erase marker may be securely held in place when not in use.

12 Claims, 3 Drawing Sheets

U.S. PATENT DOCUMENTS

| | | | | |
|---|---|---|---|---|
| 5,664,780 | A * | 9/1997 | Bricker | 273/239 |
| 5,690,426 | A * | 11/1997 | Sherman | 362/410 |
| 5,741,561 | A * | 4/1998 | Lenkin | 428/13 |
| 5,743,414 | A * | 4/1998 | Baudino | 211/69.1 |
| 5,827,072 | A * | 10/1998 | Neufer et al. | 434/416 |
| 5,901,956 | A * | 5/1999 | Warmack | 273/244 |
| 6,067,266 | A | 5/2000 | Donelan | |
| 6,203,878 | B1 * | 3/2001 | Davis et al. | 428/83 |
| 6,231,023 | B1 | 5/2001 | Morton | |
| 6,308,989 | B1 | 10/2001 | La Porta | |
| 6,837,715 | B2 * | 1/2005 | Beno | 434/408 |
| 6,878,414 | B2 * | 4/2005 | Meccia et al. | 427/495 |
| 6,941,691 | B2 * | 9/2005 | Arko et al. | 40/611.11 |
| 6,945,785 | B2 * | 9/2005 | Sohl et al. | 434/408 |
| 7,117,619 | B1 * | 10/2006 | Huber | 40/495 |
| 7,152,840 | B2 * | 12/2006 | Ottah et al. | 248/444.1 |
| 7,246,458 | B2 * | 7/2007 | Ternovits et al. | 40/600 |
| 2003/0077562 | A1 | 4/2003 | Donelan | |
| 2003/0179313 | A1 | 9/2003 | Mormino | |
| 2004/0005534 | A1 * | 1/2004 | Vickroy | 434/247 |
| 2004/0091849 | A1 | 5/2004 | Gallant et al. | |
| 2004/0197753 | A1 * | 10/2004 | Kirsch | 434/237 |

FOREIGN PATENT DOCUMENTS

| | | |
|---|---|---|
| GB | 2255532 | 11/1992 |

* cited by examiner

WHITEBOARD SCOREBOARD

CROSS-REFERENCE TO RELATED APPLICATION

This application claims the benefit of U.S. Provisional Patent Application Ser. No. 60/716,977, filed Sep. 15, 2005.

BACKGROUND OF THE INVENTION

1. Field of the Invention

The present invention relates to devices for keeping score of athletic contests, and particularly to a whiteboard scoreboard attachable to a lawn chair or other support having a scoring template imprinted thereon and an erasable surface for marking the score.

2. Description of the Related Art

Parents and other caregivers are very supportive of their child's athletic activities. However, with the excitement of the game and other activities to distract their attention, it can be difficult to remember the progress of the game with the degree of detail that their children often want to know. Parents and other spectators can try to keep track by trying to write out a scorecard with pen and paper. However, they often find that their notes are illegible or disorganized, and the statistics can be hard to reconstruct.

Although boards with erasable surfaces are available, such boards are not equipped with a template for entering running totals in a neat and organized fashion. Consequently, it is necessary to draw a chart or the like for making entries before every game, or to be very cautious when erasing entries within the chart. Even then the chart may be partially erased or blurred during storage to and from the events.

Thus, a whiteboard scoreboard solving the aforementioned problems is desired.

SUMMARY OF THE INVENTION

The whiteboard scoreboard is a dry erase marking surface laminated onto a backboard or other substrate. The board may be rectangular with rounded corners to prevent injury of an end user or anyone else coming into contact with the device. Indicia comprising baseline information or a ruled chart is permanently imprinted, engraved, or otherwise disposed along the marking surface of the whiteboard to assist the end user in scoring a game or other sporting event, such as baseball, Little League baseball, bowling, tennis, equestrian events, and the like.

The indicia includes a scoring matrix that has a predetermined number of rows and a predetermined number of columns in which the end user may erasably record scoring tallies by application of a dry erase marker to a marking area of the matrix. Optionally, an attachment clip is connected to the backboard for attachment to a chair or other support. A dry erase marker holder clip is also attached to the whiteboard so that a dry erase marker may be securely held in place when not in use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
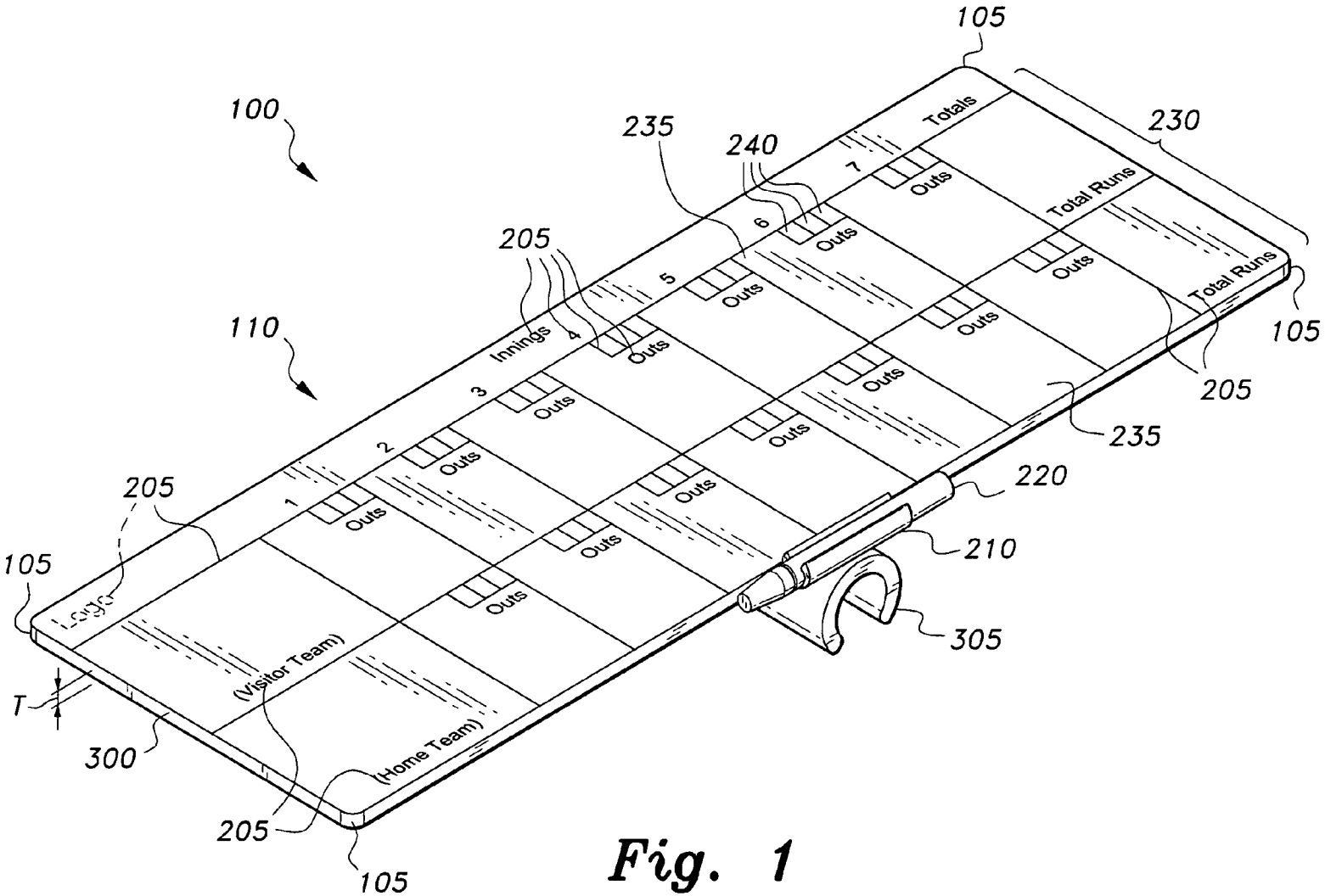
FIG. 1 is a perspective view of a whiteboard scoreboard according to the present invention.
Figure 2:
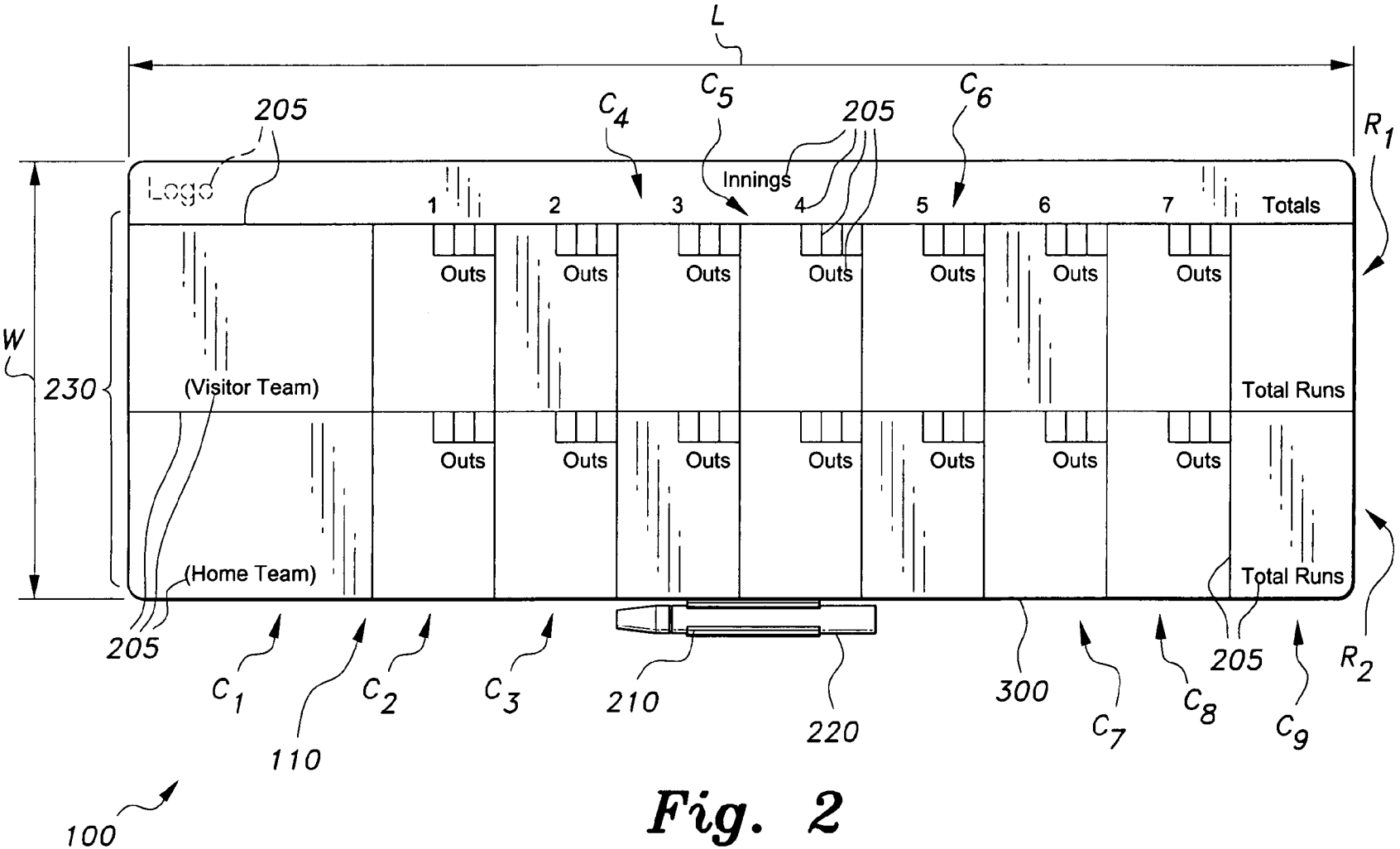
FIG. 2 is a top view of a whiteboard scoreboard according to the present invention.
Figure 3:
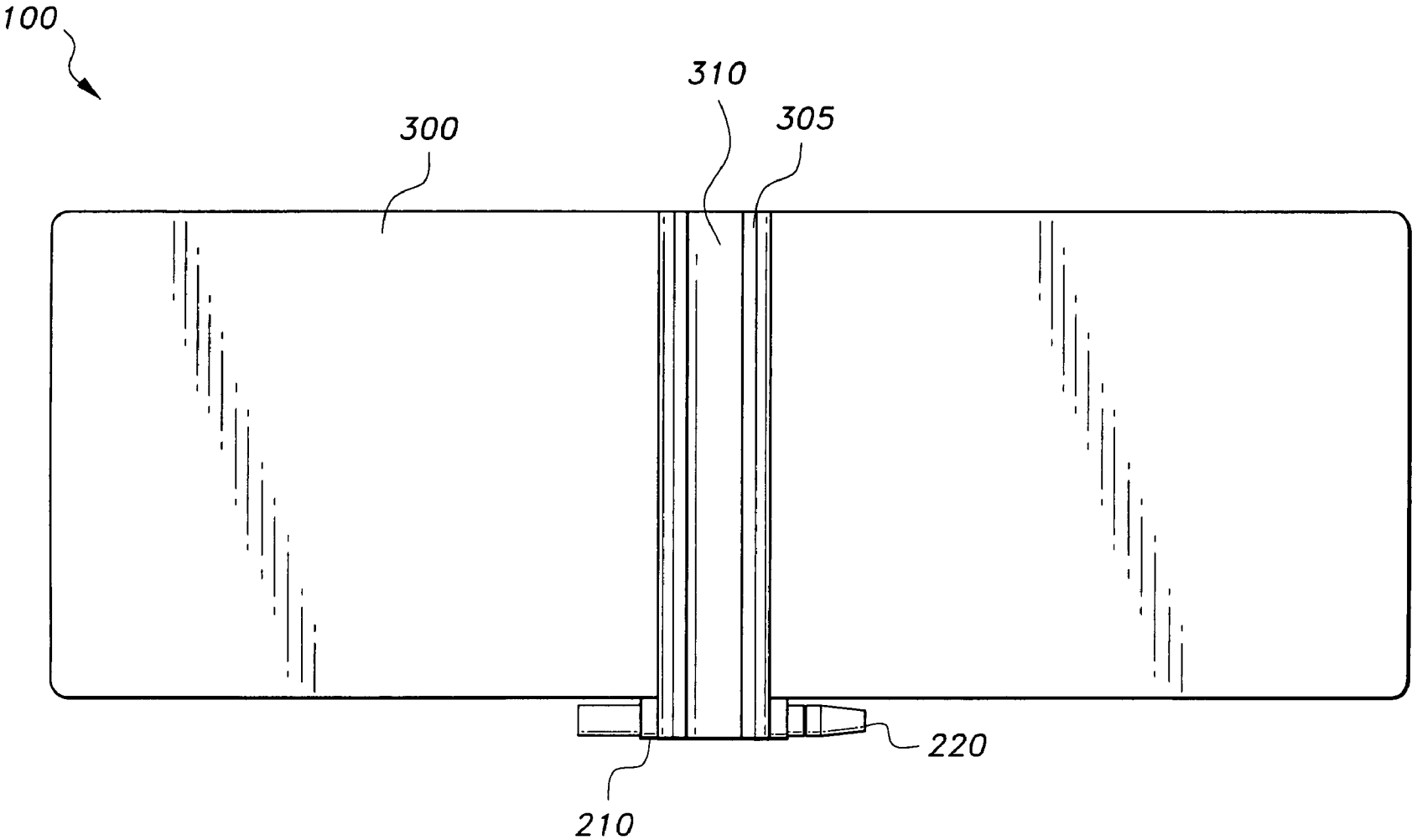
FIG. 3 is a bottom view of the whiteboard scoreboard according to the present invention.

As shown in FIG. 1, the whiteboard scoreboard 100 comprises a substantially rectangular dry erase marking surface 110 laminated onto a correspondingly shaped backboard 300 or other substrate. The corners 105 of the whiteboard 100 are rounded to eliminate any sharp edges that may injure an end user. As shown in FIGS. 1 and 2, permanent indicia 205 is imprinted or otherwise disposed along the marking surface 110 of the whiteboard.

The indicia 205 is included to aid an end user in keeping score of a sports/game event by providing a template of baseline information that rarely changes from event to event. Moreover, the indicia 205 may be inked on, etched on or otherwise affixed to the marking surface 110. In the embodiment shown, the indicia 205 comprises a 2×9 scoring matrix 230 or chart, structured as eighteen box-shaped marking areas, such as box-shaped marking area 235, distributed over two rows of approximately the same dimension and nine columns. Each box-shaped marking area 235 of the first or leftmost column is of larger dimension than the largest of any of the box-shaped marking areas provided in the remaining columns.

Each of the fourteen box-shaped marking areas defined by the columns to the right of the first column, such as box-shaped marking area 235, has additional markings delineating a plurality of smaller box-shaped marking areas 240 in an upper right hand corner of the box-shaped marking area 235. Optionally, there may be additional permanent marking indicia 205 alongside or beneath the plurality of smaller box-shaped writing areas 240, further identifying what symbols are expected to be placed in the plurality of smaller box-shaped marking areas 240.

The scoring matrix 230 may optionally take up less space than the width W of whiteboard scoreboard 100 in order to provide a strip of whiteboard surface spanning all columns of matrix 230 in which additional indicia 205 may be provided to further assist the end user in scoring the event. FIGS. 1 and 2 depict a whiteboard scoreboard 100 that has indicia 205 designed to provide scorekeeping for a seven-inning Little League baseball game.

Referring to FIG. 2, the chart cell R1-C1 in the upper left-hand corner comprising box-shaped marking area 235 has indicia 205 including the symbols "(Visitor Team)". Similarly, box-shaped marking area 235 in the lower left-hand corner R2-C2 has indicia 205 including the symbols "(Home Team)".

In addition, each of the box-shaped marking areas 235 designated by the remaining columns C2 through C8 of row R1 and row R2 respectively has indicia 205 including the symbols "Outs". Each of the box-shaped marking areas 235 designated by column C9 and rows R1, R2 respectively has a permanent marking 205 including the symbols "Total Runs". As noted above and shown in FIG. 2, the scoring matrix has a width that is less than the total width W of the marker board scoreboard 100. Thus there remains a strip of marking surface 110 for additional indicia 205, such as any end user selected indicia in the area marked "LOGO" on marking surface 110 near the extreme left hand side of the whiteboard scoreboard

100, the designation "Innings" near the center of the whiteboard scoreboard 100, and the designation "Totals" near the extreme right end of the whiteboard scoreboard 100. Indicia 205 over each of columns C2 through C8 designate an inning number of the game.

It should be understood, however, that the scope of the present invention contemplates a whiteboard scoreboard 100 that has the capability of providing a marking surface for a variety of end user applications, such as, without limitation, scoring bowling events, major league baseball, tennis, equestrian events, and the like.

Thus, it is within the scope of the present invention to provide the whiteboard scoreboard 100 with the capability of being manufactured having a predetermined number of columns and a predetermined number of rows of the scoring matrix 230, and indicia 205 modified as appropriate to adapt to events and games other than what is shown in the embodiment depicted in FIGS. 1 and 2.

Optionally, to provide convenient support while in use, a chair attachment clip 305 may be attached to the backboard 300 of scoreboard 100 along a line that divides in half the length L of scoreboard 100, and may be disposed so that an engagement channel 310 of the attachment clip 305 runs parallel to an edge of the scoreboard 100 that defines the width W of the scoreboard 100.

The attachment clip 305 may be composed of a semirigid, resilient material, such as for example PVC. The attachment clip 305 may be tubular in shape but having an opening defining the engagement channel 310 which is provided to mate to tubular shaped arm rests of typical outdoor seating, thus providing a writing support for the end user of scoreboard 100.

Alternatively, attachment clip 305 may be rotatably connected to the underside of scoreboard 100, thus providing the end user with a variety of angles with which to mark on and view the scoreboard 100 once it is attached to a chair or other surface by attachment clip 305. It is also within the scope of the present invention to provide other type attachment clips 305, such as a typical clipboard style attachment clip, a very large alligator style clip, what is known as a "bulldog clip", and the like. An attachment clip, such as the aforementioned alternative clip embodiments, may be composed of rigid material such as hard plastic, steel, and the like.

The whiteboard scoreboard 100 also has a dry erase marker holder clip 210 attached to an edge of the marker board 100, so that dry erase marker 220 may be securely held in place on the marker board 100 when not in use.

Preferably the whiteboard scoreboard should have compact dimensions to facilitate ease of use, transporting and storage. Thus, referring to FIGS. 1 and 2, the embodiment shown has a width W of approximately 3½ inches, a length L of approximately ten inches, and a thickness T of approximately 2 inch.

Although referred to as "whiteboard", it will be understood that a dry erase board of any color is within the scope of the present invention.

It is to be understood that the present invention is not limited to the embodiment described above, but encompasses any and all embodiments within the scope of the following claims.

I claim:

1. A whiteboard scoreboard, comprising:

a backboard having opposed front and rear surfaces, said backboard extending along mutually orthogonal vertical and horizontal axes, wherein said backboard defines a vertical height;

a dry erase marking surface laminated onto the front surface of the backboard to form a whiteboard having compact dimensions;

a game score template permanently imprinted on the dry erase marking surface; and, an attachment clip being disposed on the rear surface of the backboard, the attachment clip being adapted for attaching the backboard to a vertical support, the attachment clip being elongated and extending along the entire vertical height of the backboard.

2. The whiteboard scoreboard according to claim 1, wherein the scoreboard is substantially rectangular.

3. The whiteboard scoreboard according to claim 1, wherein a dry erase marker holder clip is attached to the whiteboard along an edge of the whiteboard.

4. The whiteboard scoreboard according to claim 1, wherein corners of the whiteboard are rounded to eliminate any sharp edges so as to prevent injury to an end user.

5. The whiteboard scoreboard according to claim 1, wherein the game score template comprises a scoring matrix structured as box-shaped marking areas distributed over a predetermined number of rows and columns.

6. The whiteboard scoreboard according to claim 1, wherein a logo is permanently disposed as additional indicia on the dry erase marking surface.

7. The whiteboard scoreboard according to claim 5, further comprising: the scoring matrix having indicia that are designed to provide scorekeeping for a baseball game.

8. The whiteboard scoreboard according to claim 7, further comprising: the scoring matrix having a visitor team row and a home team row; the scoring matrix additionally having a plurality of columns sub-divided into visitor team and home team score boxes, and representing innings of a baseball game; a plurality of "Outs" boxes being disposed within each score box; the scoring matrix including one column representing score totals; and, the scoring matrix having a top row that identifies the innings and totals columns.

9. The whiteboard scoreboard according to claim 1, wherein the attachment clip is composed of a semi rigid, resilient material.

10. The whiteboard scoreboard according to claim 9, wherein the attachment clip material is a thermoplastic composition.

11. The whiteboard scoreboard according to claim 1, wherein the attachment clip has an opening that defines an engagement channel, the engagement channel being provided to mate to a complementarily shaped structure of a mounting surface, the attachment clip having a substantially C-shaped cross-sectional contour.

12. The whiteboard scoreboard according to claim 1, wherein the attachment clip is rotatably connected to the rear surface of the backboard in order to provide an end user with a variety of angles with which to mark on and view the scoreboard while it is attached to a mounting surface by the attachment clip.

* * * * *